United States Patent [19]

Barker

[11] 4,126,563

[45] Nov. 21, 1978

[54] COMPOSITION FOR TREATING FABRICS, METHOD FOR MAKING AND USING THE SAME

[76] Inventor: Graham Barker, 16-11 Berdan Ave., Fairlawn, N.J. 07410

[21] Appl. No.: 863,938

[22] Filed: Dec. 23, 1977

Related U.S. Application Data

[60] Division of Ser. No. 486,351, Jul. 8, 1974, Pat. No. 4,077,890, which is a continuation-in-part of Ser. No. 335,311, Feb. 23, 1973, abandoned.

[51] Int. Cl.[2] ..... D06M 13/10

[52] U.S. Cl. ..... 252/8.8; 252/307; 427/240; 428/392; 424/26

[58] Field of Search ..... 252/8.8, 8.6, 8.75, 252/307; 106/208; 427/240, 242; 428/213, 392; 424/26

[56] References Cited

U.S. PATENT DOCUMENTS

| | | | |
|---|---|---|---|
| 1,807,810 | 6/1931 | Rice | 252/307 |
| 1,907,982 | 5/1933 | King | 252/307 |
| 2,826,506 | 3/1958 | Trusler | 106/208 |
| 2,949,426 | 8/1960 | Thiegs | 252/307 |
| 3,227,192 | 1/1966 | Griffiths | 428/392 |
| 3,442,692 | 5/1969 | Gaiser | 427/240 |
| 3,634,947 | 1/1972 | Furgal | 427/242 UX |
| 3,650,816 | 3/1972 | Rudy et al. | 252/8.6 X |
| 3,676,199 | 7/1972 | Hewitt et al. | 428/213 |
| 3,681,248 | 8/1972 | Gould et al. | 252/89 |
| 3,736,668 | 6/1973 | Dillarstone | 427/242 |
| 3,803,285 | 4/1974 | Jensen | 264/143 |
| 3,822,145 | 7/1974 | Liebowitz et al. | 252/8.8 X |
| 3,826,682 | 7/1974 | Liebowitz et al. | 252/8.75 |
| 4,041,205 | 8/1977 | Compa et al. | 252/8.6 |

FOREIGN PATENT DOCUMENTS

| | | | |
|---|---|---|---|
| 255,242 | 11/1964 | Australia | 252/307 |
| 1,240,713 | 7/1971 | United Kingdom. | |

*Primary Examiner*—William E. Schulz

[57] ABSTRACT

Composition for imparting desirable properties to fabric on clothes comprising a water-soluble or dispersible adhesive such as a gum or polymeric resin and at least one adjuvant, capable of imparting desirable properties to the fabric on clothes such as a fabric softener, for example. The composition is quickly disintegrable upon application of heat and moisture to release the adjuvant on the fabric on clothes while leaving substantially no residue of gum thereon or in the surrounding environment, such as a clothes dryer. It can be in a foamed or unfoamed condition but is preferably foamed and made by mixing the constituents, that is, the gum and adjuvant, and then whipping the mixture where a foam is desired and subsequently drying the mixture to form the composition.

8 Claims, No Drawings

COMPOSITION FOR TREATING FABRICS, METHOD FOR MAKING AND USING THE SAME

RELATED APPLICATION

This is a divisional application of Ser. No. 486,351, filed July 8, 1974 and now U.S. Pat. No. 4,077,890, which is a continuation-in-part of copending application Ser. No. 335,311, filed Feb. 23, 1973, now abandoned, the contents of which are incorporated herein, by reference, and for which all legal and equitable rights are requested.

BACKGROUND OF INVENTION

This invention relates to a new composition of matter and a method for making and using the same. More particularly, the invention relates to a new composition for treating fabric to impart desired properties thereto and to a method for making and using the same.

For many years, it has been known to add various types of adjuvants to detergents and wash cycle additives. It is also known to add adjuvants to dryers. In general, however, the adjuvants added to the wash or rinse cycles have the objective of removing soil from the fabric. However, the presence of detergents and the like in the washing machine makes it difficult to concurrently apply adjuvants which are to be present on the fabric after washing and drying. Consequently, events led to the development of adjuvants for use in dryers. In general, such adjuvants are supplied in the form of sprays or liquid coating agents and it is most difficult when using such materials in dyers to obtain substantially even distribution of the adjuvant on the fabrics. Furthermore, chemical sprays and liquid compositions have the additional drawback in that they generally contain constituents which leave an undesirable residue in the dryer and/or on the fabric. This occurs essentially from the fact that the carrier component of the composition has to be predominant and, therefore, generally constitutes a major proportion of the composition.

Recently, a product has been developed using a flexible fabric substrate on which an adjuvant, such as a fabric softener, has been applied. This product is disadvantageous in that the fabric substrate remains in the dryer and must be removed from amongst the clothes after the drying cycle. More critical, however, is the fact that the fabric substrate tends to cling and become enmeshed with the clothes and does not provide a uniformly complete distribution of the adjuvant.

Still further, common adjuvants for use in dryers have only included softners and antistatic agents. The color enhancers, color brighteners, fresheners, atmosphere scents and the like have not been employed in dryers to apply them to clothes in dryers primarily because of the lack of a suitable vehicle to accomplish this.

There exists, therefore, a need for providing compositions which can be employed in clothes dryers but which do not exhibit the disadvantages mentioned above.

It is an object of this invention to provide a composition of matter for treating clothes and to impart to the clothes any of a selected group of desired properties, such as softness, anti-static properties, scents or perfumes and brightening characteristics and the like.

It is another object of the invention to provide a solid, fabric or clothes treating composition which is simply and easily formed and which totally disintegrates in the dryer, leaving no residue, remainder, substrate and the like.

These objects, as well as others, together with the numerous advantages thereof are set forth in the following disclosure of the present invention.

BROAD STATEMENT OF THE INVENTION

In accordance with the invention, there is provided a new composition for treating fabric or clothes to impart desired properties thereto comprising a minor amount of a completely water soluble film forming adhesive such as a gum or polymeric resin and at least one adjuvant capable of imparting desired properties to the fabric or clothes, the composition being shaped into a substantially dry manipulatable form of homogeneous character which is substantially completely and quickly disintegrable upon the subsequent application of heat and in the presence of moisture and which will substantially completely release all of the adjuvant on to fabric on clothes in contact therewith and leave substantially no residue of the adhesive gum or resin on the fabric and in the environment around the fabric, as well as to the method for making and using the same.

Preferably, the adhesive is a water soluble gum or polymeric resin, plastic materials capable of being mixed with the adjuvant and to capture it either by dissolution of the adjuvant therein or by adhesion of the adjuvant thereto, forming rigid, low density mass therewith. Preferably, the composition is formed into balls, puffs or bodies, in which, because of their structure, are disintegrable over a period of time, thus providing a further advantage in giving a sustained times release distribution of the adjuvant.

DESCRIPTION OF THE PREFERRED EMBODIMENTS

According to the invention, the composition contains an amount of a water soluble or dispersible adhesive sufficient only to provide support for the adjuvant. In general, based on 100% solids on a dry basis, the composition contains no more than 20% adhesive and may contain as little as ½ to 0.1%. Preferably, the admount of adhesive would be less than 10% depending on the composition.

Based upon 100% solids the adjuvant may therefore range between 25 to 99.9%, constituting a percentage of active ingredients, (i.e. the ingredient imparting the desired properties) far in excess to that in effect to date in any of the known fabric treating products.

In addition to the basic adhesive and the adjuvant, various additives may be added to complete the composition and to enhance the stability and plasticity and to provide for controlled regulation of disintegration and release of adjuvant. Such additives should preferably be water-soluble and non-disintegrable constituents should be avoided. Up to 74% solids on a dry basis of such additives may be added.

The water soluble adhesive may be chosen from a wide variety of natural gums, polymeric resins or the like broadly called interchangeably as gums, and sometimes referred to as such herein. These gums may be ethylhydroxyethyl cellulose (E H E C), polyvinyl alcohol (P V A), carboxymethyl cellulose (C M C) (although this latter should be used only with the nonionic softeners), hydroxyethyl cellulose (H E C) and hydroxypropyl cellulose and the like. Preferably, these gums should be of high viscosity, that is a Brookfield Viscosity over 1000 using standard spindle and temperature. In addition, carbohydrate gums, in general, may also be used. Among the suitable carbohydrate adhesives are animal gums, plant gums and derivatives, such as cellulose ethers, cellulose esters, starches, starch ethers, starch esters, amylose, amylopectin and their ester and ether derivatives, locust bean gum, guar gum, gum arabic and related seed gums and plant exudate gums, marine plant gums, such as algins, carrageenans, laminarins and agar, and water-dispersable protein gums of the classes such as animal proteins, for example, hydrolyzed keratins and egg albumin and vegetable proteins such as gluten.

Other gums of the polymeric resin type which exhibit film forming properties or adhsiveness are suitable. Such resins may be water soluble or dispersible and may be polymers comprising vinyl esters, acrylate esters, crotonate esters, acrylamides and other low molecular weight hydrophilic monomers that impart water solubility. Homopolymers, copolymers and terpolymers of these monomers are effective. Such classes may be: Polyvinylpyrollidone and its copolymers with acrylates, acetates and acrylamides; acrylamides; polyethylene glycols of molecular weight greater than 1,000,000 such as "Polyox" (TM Union Carbide); polyacrylates, methacrylates, vinylacetates and their copolymers and terpolymers with crotonates, allyl esters and ethers. Cationic polymers such as alkyl acrylate and other vinyl containing esters or ethers copolymerized with vinyl containing cationic or diamine monomers such as NN dimethyl propylene diamine amide or NN dimethyl propandamine ester of acrylic or methacrylic acid. Such a polymer is "Catrex" available from National Starch Co. Cationic cellulosic esters such as polymer JR (Union Carbide) film forming cationic polymers such as "GAFQUAT" (GAF Corp.), can also be used. These examples are suggested types which can be utilized within the scope of this invention but the invention is not limited only to the types described. Mixtures of these resins may of course by used, as well.

A wide variety of adjuvants can be employed in the composition of the invention. More specifically, adjuvants useful in the composition of this invention include, but are not limited to those set forth hereinafter:

Fabric softeners such as quaternary ammonium compounds of the formula (I) $N(R_1R_2R_3R_4)X$, and the reaction product of about 2 moes of a fatty acid of the formula (II) $R_5COOH$ and hydroxethylene-diamine, aminoethylethandiamine or other alkandiamines where $R_1$ and $R_4$ are from a $C_{16}$ to $C_{20}$ alkyl group, $R_2$ and $R_3$ are from a $C_1$ to $C_4$ alkyl group, $R_5$ is a $C_{16}$ to $C_{20}$ alkyl group and X is a anion imparting water dispersibility to the cationic ammonium compound.

Typical commercial products commonly available for use in the present invention include distearyl dimethyl ammonium chloride, such as sold by Armour Chemical Corp., under the Trade name ARQUAD 2 HT (hereinafter generally referred to as 2HT) and the reaction product of approximately 2 moes of stearic acid with approximately 1 mole of hydroxyethylene diamine. The last-mentioned product is a mixed chemical structure due to the multifunctional characteristics of the diamine reactant. Spectral analysis of a commercial product prepared through the fatty acid-diamine reaction indicates that it contains in the order of 25 percent quaternary compounds of the imidazoline type, the balance thereof being mixed esters and amides. Softeners related to this last mentioned compound also include the quaternized products of about 2 moles of oleic acid reacted with 1 mole of hydroxyethylene diamine and the product of about 2 moles of a mixture of oleic and stearic acids reacted with about 1 mole of hydroxyethylene diamine. Other suitable fabric softening agents which may be used in the present invention include those which have been described in "Proceedings of the American Association of Textile Chemists and Colorists," American Dyestuff Reporter, pages P42 and P43, Jan. 28, 1957.

Optical brighteners such as disulfonated diaminostilbene compounds disclosed in Alien Property Custodian publication No. 381,856, and U.S. Pat. No. 2,612,501, and triazole compounds of the type disclosed in U.S. Pat. No. 2,784,183 can also be employed in the compositions of the invention.

Essential oils and fragrances can also be used in the compositions of the invention. In using materials of this category, however, since many substances of this type are normally in liquid form, they must be combined with a suitable carrier having the desired waxiness, thermal stability, and hardness to obtain a suitable composition. Suitable waxy carriers which may be used as needed are discussed below.

Antistatic agents which in many cases are compounds of the same general structure discussed above with respect to fabric softening compounds can also be used in this invention. Quaternary ammonium compounds, as well as other fabric softening agents may be enhanced by combining these materials with ethanolamides such as tallow ethanolamide.

Germicides such as the halogenated salicylanilides, hexachlorophene, neomycin sulfate, benzalkonium quaternary compounds, and the like can also be employed. The halogenated salicylanilides which have found the most widespread acceptance are tribromosalicylanilide and polybromosalicylanilide, the latter being a mixture primarily of dibromosalicylanilide and tribromosalicylanilide.

Soil release agents such as the polyacrylic polyvinyl alcohol compositions described, for example, in U.S. Pat. No. 3,377,249, can also be used.

Non-ionic agents, fatty amides and fatty ethoxylides may also be used as softening agents. Among these are Amide Types characterized by the formula

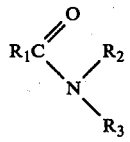

(III)

wherein $R_1$ is derived from $C_{12}$ to $C_{18}$ saturated fatty acids, and $R_2$ and $R_3$ are $—C_2H_4OH$, or $—C_2H_4NH_2$, respectively.

For example, this type would include stearic diethanolamide. Non-ionic types of materials such as fatty ethoxylate esters and ethers characterized by the formulae:

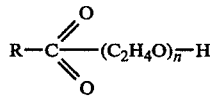

and $$R-O-(C_2H_4O)_n-H$$

wherein $n$ is 3 to 20 and derived from 3 to 20 mols of ethylene oxide can also be employed in the compositions of this invention. These types of materials also include monoglycerides having the formula:

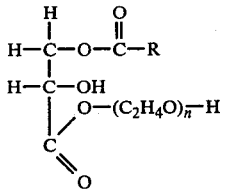

wherein $n$ is as defined above and R is derived from a $C_{12}$–$C_{18}$ saturated fatty acid.

Optionally the ethoxylated-glycerylmonostearate with 10 Mols of ethylene oxide may be used.

The additives which may be used herein also include, salts, urea, glycols, ammonium chloride and similar water soluble bulk and solubility rate modifiers such as polysaccharides, dextrines, sugars.

Preferably the gum is premixed in water to form a solution having a low solid to water ratio, preferably in the range of 1–20% solutions. The greater the percentage of water the less the density of the resultant product, although the mixing procedure and drying rates are directly influenced by the amount of water used. Preferably, a 10% solution of the adhesive is used.

The adhesive solution is prepared and to it are added the adjuvants and additives in the desired amounts. The mixture is blended until a uniform dispersion is formed, and may then be cast, molded, extended, shaped etc., and dried in sizes and shapes of any desired configuration. Preferably, the blended mixture is whipped and violently agitated to create a foam. A desirable foam resulting from the whipping action would have a density range of 0.2 to 0.8 and a bubble size of 5 to 50 microns. Whipping should therefore be controlled to obtain such limits. The adhesives suggested here are all good foamers and do not necessarily require foaming agents or starters, although they may be used. The additives such as the salts, glycols etc., may be used for the foaming process. The mixture is whipped until a rigid stable foam is produced, and is thereafter extruded, ladled or spooned into individual portions and dried by forced heating or by allowing the water to evaporate under normal room temperature and humidity conditions. Preferably, the composition is dried to a relative moisture content of less than about 2%.

The composition can be shaped before or after drying. Drying can be done in radar ovens, gas dryers, and the like.

The resultant product is self supporting, cohesive and can be packaged in any shape, form, volume, or weight desired. The product further comprises a homogeneous mass in which the constituents are uniformly dispersed within each other, so that a substrate or other carrier is neither required or desirable.

Because of the use of relatively minor amounts of adhesive and a high concentration of the adjuvant the mass of the resultant product has a relatively low density.

The density of the product can be varied by varying the percentage of water in the mixture, although of course whipping and drying time may be increased.

Preferably, the foam is formed into disks, balls or puffs of approximately 3–10 grams in weight. The size or volume of such balls will of course depend upon the density of the foam. Because of the structure and physical properties of the ball, the foam disintegrates over a period of time, providing a time release to the adjuvant held therein. The rate of disintegration is also dependent upon the exposed surface of the shape. Therefore, a ball may be preferred since it presents the largest surface. A ball of approximately 10 grams will disintegrate over a period of 30 minutes. Even a ball of 3 grams will take approximately 5 to 10 minutes to disintegrate. Thus, the present invention provides for release of adjuvant uniformly over a sustained time period, insuring that all portions of fabric on clothes tumbled in the dryer will receive adjuvant, and the absorption of all of the adjuvant by only a portion of the fabric on clothes is prevented. Since all of the plastic is disintegrable, all of the adjuvant in the foam is released. It is to be noted again that the adjuvant may comprise 25 to 99½% of the foam, well above the level of active ingredients found in known products.

It is to be noted that the solubility of certain gums is directly proportional to heat, such as polyvinyl alcohol and hydroxyethyl cellulose, that is, the more heat to be applied in the dryer, the faster the adjuvant is expected to be released. However, once P.V.A. is foamed and formed into a puff and ball, the application of heat and moisture is effective only on the exterior surface, which is believed to react by controlled continuous solvation of the surface. Thus, the time release capacity of the present composition is obtained.

EHEC and some of the other gums on the other hand, are soluble in inverse proportion to heat. Consequently, even though it would not be expected, or obvious to use them, it has been found the EHEC in particular is most suitable as a carrier because as the heat of the dryer increases, the composition tends to defer disintegration, thus providing, even with these materials, a sustained time release action.

The combination of EHEC type gums and/or methocel with the P.V.A. and HEC type gums can be advantageously made to provide a composition in which the release time can be selectively controlled.

Release time is further controllable by varying the size of the shaped product formed with the composition, as well as the density of the composition, since it will be obvious that in either event the bulk amount of the plastic carrier determines the rate at which release of the adjuvant occurs.

The following examples are given as being illustrative of the present invention. In the Examples all parts and percents are by weight unless otherwise stated.

EXAMPLE I

A 1½% aqueous solution of HEC (Cellosize QP 1500 made by Union Carbide Corp.) was prepared. To 100 grams of this solution 3.5 grams of dried, powdered HEC was added slowly and with agitation until a uniform dispersion was obtained. To this mixture 9 grams of urea powder was added slowly and with agitation. When the urea was fully dispersed 36 grams of 2HT powder was added to the mixture and the mixture was whipped.

The entire mixture was subjected to whipping in a Hobart Mixer, raising the speed from setting #1 to #8 over a two minute period. Mixing was maintained at the higher speed for approximately 5 minutes in which time the mixture foamed to a rigid mass having a foam density of approximately 0.4. The foam was capable of retaining its shape over an extended period of time, and capable of being ladled. The material was then ladled out and/or extended at random on a metal sheet in quantities of approximately 10 to 30 grams each. The material assumed ball or puff like shape on ladling and was thereafter left to dry at room temperature at ambient moisture conditions for a period of approximately 8–24 hours until the ball or puff like shapes exhibited a moisture content of less than 2%, as measured by the Karl Fischer Method. The dried balls retained the shape and the size of the wet ladled material but weighed approximately 30% to 70% less than when wet, resulting in dry balls of very low density of approximately 3 to 10 grams each.

The dried puffs were stored at room temperature (at about 20°–25° C.) and normal atmospheric conditions over an extended period without substantially changing in size, moisture content and density. It is believed that storage and shelf life is indefinite.

Over a period of time, several puffs at one time were placed, together with a load of wet clothes, in a household clothes dryer. The puffs disintegrated over a time period of 5 to 30 minutes depending on their size and the dried clothes exhibited a uniform softness and anti-static nature. No portion of the clothes or portions of individual garments were found to be free of the softening and anti-static effect, thus indicating a complete and uniform transference of the adjuvant to the fabric.

The composition of the final dried product was:

10% HEC
72% 2HT
18% Urea

EXAMPLE II

The procedure of EXAMPLE I was repeated except that a 10% aqueous solution of polyvinyl alcohol was prepared. To 50 grams of this solution 45 grams of 2HT powder were added and the mixture was whipped to a foam density 0.3 and until a rigid structure was obtained. This provided a 90% adjuvant and 10% gum when dried.

When applied to clothes in a household clothes dryer, results like those in EXAMPLE I were obtained.

EXAMPLE III

The procedure of EXAMPLE I was repeated except that to 50 grams of the PVA solution described in EXAMPLE II, 150 grams of Arquad 2HT powder was slowly added, under valid agitation, until a uniform pasty mass was obtained. The mass was capable of being mechanically handles, extruded and/or ladled. The resultant dried mass had the following composition:

3.2 gum
96.8 adjuvant and was non-foamed. The mass was divided into balls and used as indicated in EXAMPLE I and with like results.

EXAMPLE IV

A 2% solution of Klucel (Hercules Powder Corp.) was prepared. To 75 grams of this solution 1½ grams Klucel, 90 grams of Ammonyx 2194 - P40 (Onyx Chemical) was added and mixed until uniformly dispersed. Ammonyx comprises 60% urea and 40% distearyl dimethyl ammonium chloride. To the resultant mixture was added 7 grams of polypropylene glycol 400. A portion of the mass was whipped as in EXAMPLE I until foamed to a density of 0.7. The remainder was mildly mixed as in EXAMPLE II until a pasty non-foamed mass was obtained. Each portion had the following composition when dried:

3% gum
90% Ammonyx 2194-P40
7% Glycol

The Glycol softens or plasticizes the plastic structure and also helps to control the rate of release. Preferably, the Glycol is best when in solid form such as "Carbowax" 6000 (TM Union Carbide).

EXAMPLE V

The procedure of Example I was repeated except that to 100 grams of PVA (at a 10% solution) there was added 40 grams of Arquad 2HT powder. The mixture was whipped to a foam density of 0.2 and dried as per EXAMPLE I. The resultant composition contained:

20% PVA
80% 2HT

Unless high heat is applied to this composition in the dryer, a certain small amount of residue may remain because of the relatively high percentage of gum. However, it is still usable. The disintegrability of the product can be controlled by the addition of certain water soluable additives, such as urea, propylene glycol and other materials.

EXAMPLE VI

EXAMPLE V was repeated except that 10 grams of Carbowax 6000 and 10 grams of ammonium phosphate was substituted for ½ the adjuvant to provide an end product containing:

10% PVA
40% 2HT
20% Carbowax 6000
30% Am Phosphate

When employed in a dryer as in EXAMPLE I, like results were obtained.

EXAMPLE VII

The procedure in EXAMPLE I was repeated except that to 15 grams of PVA (at a 10% solution), 100 grams of a 2% solution of Klucel (hydroxypropylcellulose) 1500–2000) was blended in. To this mixture of gums was further added 44 grams of 2HT powder, 2.5 grams of propylene glycol and the mixture was processed as in EXAMPLE I with a portion of the processed mixture foamed and a portion dried in the unfoamed state. Analysis of the dried material in both the unfoamed and the foamed states was:

3% PVA
4Klucel
88% 2HT
5% Propylene glycol

When employed as in EXAMPLE I, similar results were obtained on clothes in a household dryer.

EXAMPLE VIII

The procedure of EXAMPLE I was repeated except that to 100 grams of Cellosize (QP 1500 at a 1½% aqueous solution) there was added 300 grams of 2HT powder. Analysis of the final composition indicated that it contained:

½% gum
99½% adjuvant

When employed in a dryer as in EXAMPLE I, like results were obtained.

EXAMPLES IX AND X

The foam of each of EXAMPLES VII AND VIII was made with 20 grams of ammonium phosphate added to the respective mixtures resulting in an immediate collapse of the foam and a decrease in viscosity. Thereafter 90 grams more of 2HT was added to the mixture permitting a doubling of softener content over the original mixture. The processing of EXAMPLE I was repeated and the foam structure rebuilt. Thus an even greater content of adjuvant can be incorporated into the mixture, than was possible earlier. When employed in a dryer as in EXAMPLE I, like results were obtained.

EXAMPLE XI

To 100 grams of a 1½% Aqueous solution of Cellosize (hydroxyethylcellulose (1500 grade) was added 1 gram of dry powdered Cellosize 1500 and 10 grams of the germicide Hyamine 10X (diisobutyl cresoxy ethoxy ethyl dimethyl Benzyl Ammonium Chloride). The mixture was blended at low speed as in EXAMPLE I until homogeneous. 20 grams urea and 17.5 grams Arquad 2HT powder was added and processed as in EXAMPLE I.

The final product was in part foamed and in part non-foamed. When dried each part had the following final composition.

5% Gum
20% Hyamine 10X (Germicide)
40% Urea
35% Arquad 2HT

The composition contained 20% Germicide and Fabrics treated with this composition showed effective reduction of static electricity, excellent softening and reduction of bacterial flora. Thus a multiple action of softening and anti-bacterial activity was imparted by this composition.

EXAMPLE XII

EXAMPLE XI was repeated but Cetyl Trimethyl ammonium chloride was substituted for Hyamine 10X. The mixture was processed as in EXAMPLE I and the resultant dried product exhibited effected anti-bacterial activity when fabric was treated as described in EXAMPLE XI.

EXAMPLE XIII

To 80 grams of a 10% solution of PVA, 20 grams of urea was blended at low speed until uniform. 10 grams of Emcol E607 (lauryl colamino methyl formyl pyridinium chloride) was added followed by 12 grams of ethoxylated (10 mols Eo) glyceryl monostearate. When processed as in EXAMPLE I the dried composition was as follows:

16% PVA
40% Urea
20% Emcol E607
24% Ethoxylated Gms

When employed in a dryer as in EXAMPLE I, there was demonstrated anti-bacterial, softening and anti-static activity.

EXAMPLE XIV

The foam of EXAMPLE XI was prepared with 5 grams Fragrance CS 10409 ("Fresh and Clean") (Albert Verley Co.) added to the mixture. There was a collapse of foam and decrease in viscosity due to the oily defoaming nature of the fragrance composition. 20 grams additional 2HT powder was added and the resultant mixture was foamed to a foam density of 0.3. The foam was extruded and dried as in EXAMPLE I.

When added to the dryer, clothes treated with this composition, in addition to the aforementioned anti-static anti-bacterial properties had a pleasant fresh and clean odor.

EXAMPLE XV

To 100 grams of Cellosize 1500 (1½% solution) 1 gram of powdered Cellosize 1500 gum was added and blended at low speed until uniform. 20 grams of Urea and 20 grams 2HT powder was added and blended until homogeneous. 5 grams of Verley Co.'s fragrance CS 10410 ("Sunshine fresh") was added and the mixture foamed and processed as in EXAMPLE I. The Urea tended to bind the liquid fragrance into a solid composition which was released in the dryer under application of heat and high humidity. Clothing treated in this manner exhibited softening with a concomitant sunshine fresh odor.

EXAMPLE XVI

A 2% solution of Cyanomer P-250 (Trademark of American Cyanamid for polyacrylamide) was prepared. To 50 grams of this solution, 5 grams of polyglycol 400 and 10 grams of sugar were added with mixing. When the mixture was uniform, 40 grams of 2HT powder was added and the entire mixture was subjected to whipping in a Waring Blender until a stable foam was obtained. The wet foam was extruded onto drying trays and dried to less than 2% moisture. The resulting mass when dried had the following composition:

1.78% Polyacrylamide
17.80% Sugar
8.90% Polyglycol 400
71.52% dihydrogenated tallow dimethyl ammonium chloride The dried foam when apportioned and added to the drier as indicated in Example I resulted in leaving the clothes with a soft feel and free of static electricity and minimized ironing.

EXAMPLE XVII

A 10% solution of polyvinyl pyrollidone (GAF-brand PVPK-90) was prepared. To 35 grams of this polymer solution, 40 grams of ethoxylated glyceryl monostearate and 3 grams of sodium lauryl sulfate were added. The entire mixture was blended until uniform and 60 grms water added, then whipped at the appropriate speed in a Hobart mixer until a stable foam resulted. The foam was treated as in example I and had the same results. The final composition of the dried foamed mass was as follows:

Ethoxylated glyceryl monostearate: 86.0%
Sodium lauryl sulfate: 6.5%
Polyvinyl pyrollidone (PVPK-90): 7.5%.

The dried foam when apportioned and added to the drier as indicated in Example I resulted in leaving the clothes with a soft feel and free of static electricity and minimized ironing.

EXAMPLE XVIII

A 10% solution of Polyox WSR 301 (Union Carbide-hi.mol.wt. polyethylene oxide) was prepared. To 50 grams of this resin solution 40 grams Arosurf (Ashland Chemical) TA-100 was added and the mixture was then placed in a Hobart Mixer. 5 grams of Polyglycol 400 were then added and the mixture then whipped until a stable foam was obtained. When extruded and dried the dried foam mass had the following composition:

D,tallow dimethyl ammonium chloride: 80.
Polyethylene oxide (Polyox): 10.
Polyglycol 400: 10.

The dried foam when apportioned and added to the drier had the same results as described in Example I.

EXAMPLE XIX

Two grams of Gafquat 755 was added to 31 grams water and mixed till uniform to yield a 3% solution of the cationic polymer. GAFQUAT is a 50% solids solution of a cationic polymer manufactured by GAF Corp. To the 33 grams of the 3% solution, 5 grams of Polyglycol 1000 and 5 grams of dextrose were added. The mixture was blended till uniform and then 57.5 grams of Adogen 442 was added. Adogen 442 is a 75% active paste form of dimethyl ditallow ammonium chloride manufactured by Ashland Chemical. The entire mixture was then whipped at the appropriate speed in the Hobart blender until a stable foam was obtained. The foam was treated as in Example I with the same results. The resultant composition of the dry foam was as follows:

GAFQUAT Polymer: 2%
Polyglycol 1000: 10%
Dextrose: 10%
Ditallow dimethyl ammonium chloride: 86%

EXAMPLE XX

To 10 grams of Catrex resin solution, 30 ml of water and 48 grams of Adogen 442 were added and blended in a Hobart blender till uniform. Twenty-five ml of water was then added and the entire mass was whipped until a stable foam resulted. The final wet foam had a density of 0.35 grms/ml and had a uniform bubble size of 5–10 microns. The foam was extruded onto drying trays and dried to a resulting moisture content of less than 1%. The resultant dried foam had good strength and structure and when approtioned and added to the drier imparted a high degree of softness to the clothes and completely eliminated static electricity from synthetic fabrics.

Catrex is a 40% solution of a copolymer of an alkyl acrylate and a hydroxyalkylamino ester of acrylic acid manufactured by National Starch Corp.

EXAMPLE XXI 40 grams of stearic diethanolamide was melted into 360 grams of water to yield a 10% aqueous solution. 5 grams of sodium lauryl sulfate was added to the thick paste and the entire mass was then whipped in a Hobart mixer for 10 minutes. To the dense foam 8.35 grams of Ucar Latex 131 (Union Carbide's 60% solids polyvinyl acetate latex) were added and the entire mass was mixed until uniform. The dense foam was then extruded onto drying trays and dried to a moisture level of less than 1%. The dried foam when added to the drier as in Example I softened clothes and eliminated static electricity.

Resulting composition was as follows:
Stearic diethanolamide: 80
Sodium lauryl sulfate: 10
polyvinyl acetate: 10

EXAMPLE XXII

In a Hobart mixer, 40 grams of molten ethoxylated glyceryl monostearate, and 300 grms of water were added. The mixture was blended till uniform and then 5 grams of sodium lauryl sulfate powder was added and the entire mixture was then whipped to a stable foam. 15 grams of sucrose was then blended into the foam followed by 11 grams of UCAR LATEX 680 (UCAR LATEX 580 is a 46% solids styrene-acrylic interpolymer manufactured by Union Carbide Corp.). The stiff stable foam was the extruded onto drier trays and ried and tested as in Example I, with the same results. The composition of the dried mass was as follows:

Ethoxylated glyceryl monostearate: 61.5
Sucrose: 23.1
Styrene Acrylic interpolymer: 7.7

EXAMPLE XXIII

Stearic diethanolamide was used instead of ethoxylated glyceryl monostearate as in example XXII and the entire procedure of Example XXII was followed with the same results.

EXAMPLE XXIV 10 grams of Catrex resin solution was added to 200 grams of water, 15 grams of Polyglycol 1000 Monostearate and 50 grams of varisoft 475 were then added to the Catrex resin solution and the entire mass was whipped in a Hobart Blender until a stable foam was obtained. VARISOFT 475 is a 75% Aqueous paste of Methyl 1-alkyl amidoethyl 2-alkyl imidazolinium methosulfate manufactured by Ashland Chemical Co.

The stable foam was ladled onto drier trays and dried to a moisture content of less than 3%. The dry foam mass when tested in a drier as in example I exhibited excellent softening properties on fabrics an eliminated static electricity on synthetics.

EXAMPLE XXV 10 grams sucrose and 10 rams polyglycol 600 were substituted for the polyglycol 1000 monostearate as in Example XXIV and the procedure of Example XXIV was followed. A foam having a lighter density was obtained which when dried and tested as in Example I had the same results. The composition of the dried product was as follows:

Catrex resin: 8%
Sucrose: 16%
Polyglycol 600: 16%
Methyl 1 alkylomidoethyl 2 alkyl-imidazolinium methosulfate: 60%

EXAMPLE XXVI

To 90 grams of water, 3 grams of a 3% aqueous Natrosol 250 MR solution and one gram of 10% Cyanomer P-250 (aqueous solution) were added and the solution was mixed until clear. 10 grams of Polyglycol 400 and 15 grams of Sucrose were then added during the blending operation. 53 grams of Adogen 442 was then added and the entire mixture was then blended at a higher speed until a stable foam was obtained. The foam density was 0.22 and the bubble size was uniform and 5–10 microns. The foam was extruded and dried as in previous examples and tested in a clothes drier with results obtained similar to Example I. The composition of the dried foam was as follows:

0.14% Natrosol 250MR. (Hercules Chemical-Hydroxy Ethyl Cellul.)
0.15 Polyacrylamide
15.30 Polyglycol 400
23.00 Sucrose
61.41 ditallow dimethyl ammonium chloride

EXAMPLE XXVII

Example XXVI was repeated using stearyl betaine instead of Adogen 442 and the final dry foam had the same properties when evaluated as in Example I.

Various embodiments have been shown, together with numerous examples. These are illustrative only of the scope and adaptability of the present invention and should not be limiting in any manner of the present invention. Those skilled in this art will early recognize changes in both formulation, structure and use which follow directly from the invention.

What is claimed is:

1. A composition for treating fabric or clothes to impart desired properties thereto comprising a homogeneous aqueous mixture of a minor amount of an adhesive and at least one adjuvant capable of imparting softness, brightness, fragrance, antistatic, germicidal and/or soil release properties to said fabric or clothes, said composition being substantially completely and quickly disintegrable upon the application of heat and in the presence of moisture to substantially completely release all of said adjuvants on fabric or clothes in contact therewith and to leave substantially no residue of said adhesive on said fabric or clothes and in the environment around said fabric or clothes.

2. The composition as defined in claim 1 wherein said adhesive is a resin selected from the group consisting of vinyl esters, acrylate esters, crotonate esters, acrylamides, their homopolymers, copolymers and terpolymers.

3. The composition according to claim 1 wherein the adjuvant is a fabric softener.

4. The composition as defined in claim 3 wherein the fabric softener is distearyl dimethyl ammonium chloride.

5. The composition as defined in claim 3 wherein the fabric softener is the reaction product of a fatty acid of the formula, $R_5COOH$ and hydroxyethylene diamine wherein $R_5$ is a $C_{16}$ to $C_{20}$ alkyl group.

6. A method for treating fabric or clothes to impart desired properties thereto comprising disposing said fabric or clothes in a dryer and contacting said fabric or clothes with an aqueous homogenous composition comprising a minor amount of water-soluble adhesive and at least one adjuvant capable of imparting softness, brightness, fragrance, antistatic, germicidal and/or soil release properties to said fabric or clothes, substantially completely disintegrating said composition under heat and moisture in said dryer and releasing substantially uniformly all of said adjuvant on said fabric or clothes while leaving substantially no residue of said adhesive thereon and in said dryer.

7. The method as defined in claim 6 wherein the adjuvant is a fabric softener.

8. The method as defined in claim 6 wherein the adjuvant is distearyl dimethyl ammonium chloride.

* * * * *